US010136731B1

(12) United States Patent
Garza

(10) Patent No.: US 10,136,731 B1
(45) Date of Patent: Nov. 27, 2018

(54) STAIRCASE MOUNTABLE CHAIR ASSEMBLY

(71) Applicant: Andrew Garza, Manteo, NC (US)

(72) Inventor: Andrew Garza, Manteo, NC (US)

( * ) Notice: Subject to any disclaimer, the term of this patent is extended or adjusted under 35 U.S.C. 154(b) by 0 days.

(21) Appl. No.: 15/724,932

(22) Filed: Oct. 4, 2017

(51) Int. Cl.

| | |
|---|---|
| ***A47C 7/00*** | (2006.01) |
| ***A47C 3/40*** | (2006.01) |
| ***A47C 3/18*** | (2006.01) |
| ***A47C 7/62*** | (2006.01) |

(52) U.S. Cl.
CPC ..... *A47C 7/008* (2013.01); *A47C 3/18* (2013.01); *A47C 3/40* (2013.01); *A47C 7/62* (2013.01)

(58) Field of Classification Search
CPC .. A47C 7/008; A47C 3/18; A47C 3/40; A47C 7/62
USPC ..... 182/33; 297/338, 344.26, 344.21, 188.01
See application file for complete search history.

(56) References Cited

U.S. PATENT DOCUMENTS

| | | | | |
|---|---|---|---|---|
| 2,568,988 | A * | 9/1951 | Childs | A61B 90/60 297/344.18 |
| 3,599,750 | A | 8/1971 | Serwer | |
| 4,974,620 | A * | 12/1990 | Quillan | A61H 3/00 108/25 |
| 5,364,163 | A * | 11/1994 | Hardison | A47C 3/18 297/344.21 |
| 5,720,517 | A | 2/1998 | Protho | |
| 7,097,241 | B2 | 8/2006 | Tally et al. | |
| 8,596,651 | B2 | 12/2013 | Canova | |
| 8,973,926 | B1 | 3/2015 | Lensing | |
| D750,391 | S | 3/2016 | Lensing | |
| 9,486,914 | B1 | 11/2016 | Frolander | |

FOREIGN PATENT DOCUMENTS

| | | |
|---|---|---|
| WO | WO2005030007 | 4/2005 |

* cited by examiner

*Primary Examiner* — Milton Nelson, Jr.

(57) ABSTRACT

A staircase mountable chair assembly for usage while working on a staircase includes a pair of supports. The supports are attached together and have a shape to retain the supports in an upright position. A base is attached to and extending outwardly from the supports. The base lies in a horizontal plane when the supports are positioned in the upright position. The base is positioned on an upper step when the supports are on a next adjacent lower step. A post is attached to and extending upwardly from the base. The post has an upper end with a seat attached thereto.

10 Claims, 5 Drawing Sheets

STAIRCASE MOUNTABLE CHAIR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to chair assemblies and more particularly pertains to a new chair assembly for usage while working on a staircase.

BRIEF SUMMARY OF THE INVENTION

An embodiment of the disclosure meets the needs presented above by generally comprising a pair of supports. The supports are attached together and have a shape to retain the supports in an upright position. A base is attached to and extends outwardly from the supports. The base lies in a horizontal plane when the supports are positioned in the upright position. The base is configured to be positioned on an upper step when the supports are on a next adjacent lower step. A post is attached to and extends upwardly from the base. The post has an upper end and a seat is attached to the upper end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
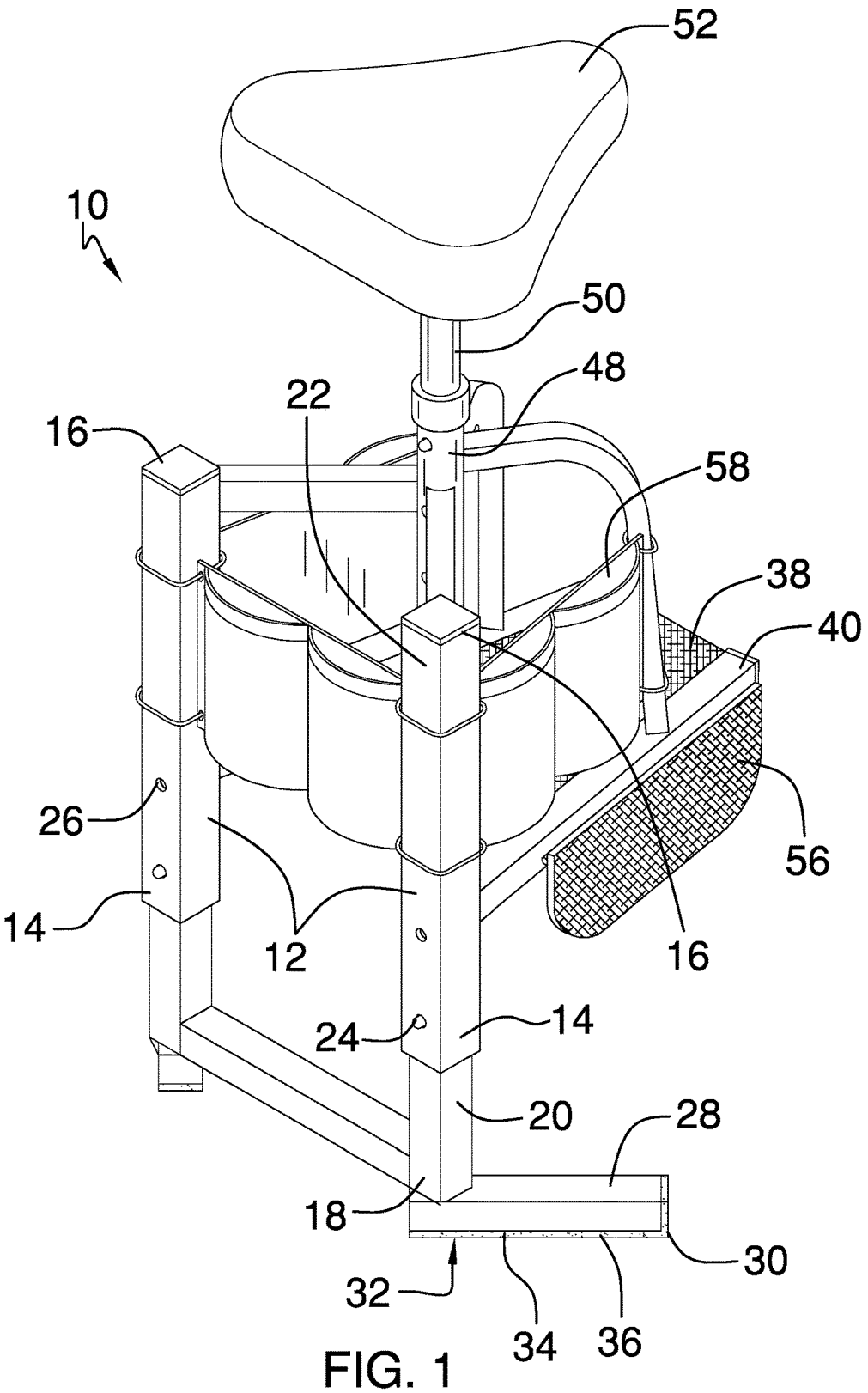
FIG. 1 is a back side view of a staircase mountable chair assembly according to an embodiment of the disclosure.
Figure 2:
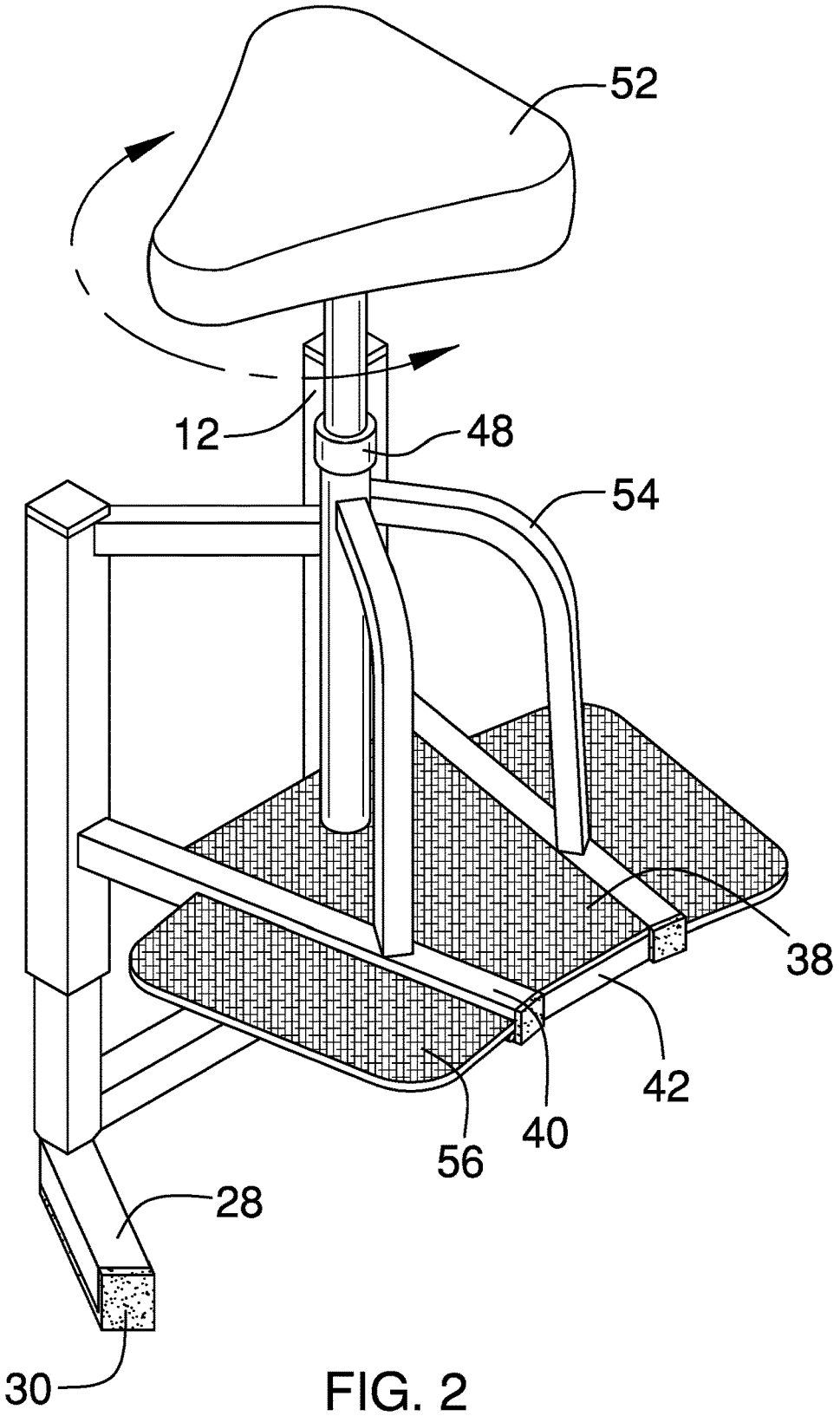
FIG. 2 is a front side view of an embodiment of the disclosure.
Figure 3:
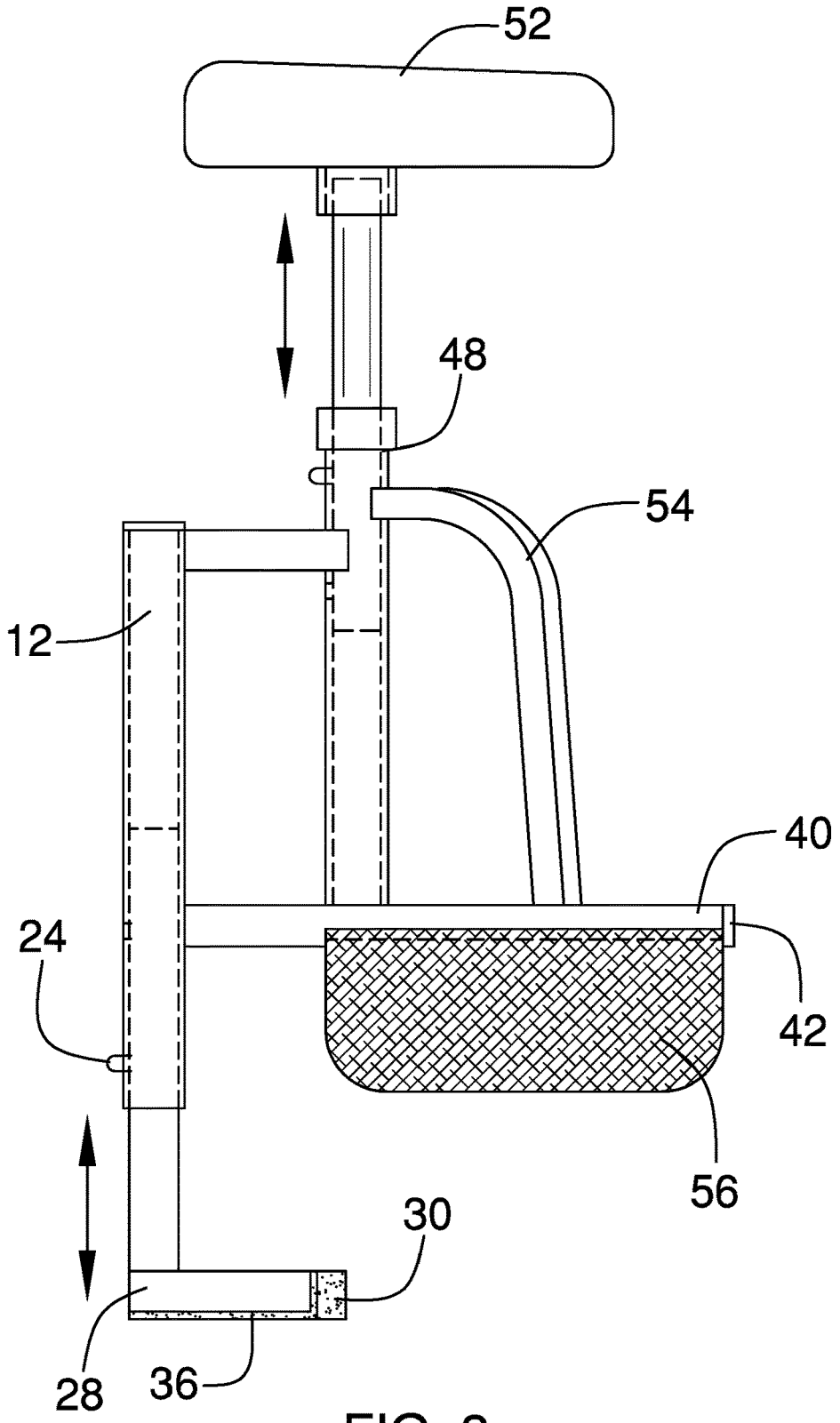
FIG. 3 is a side view of an embodiment of the disclosure.
Figure 4:
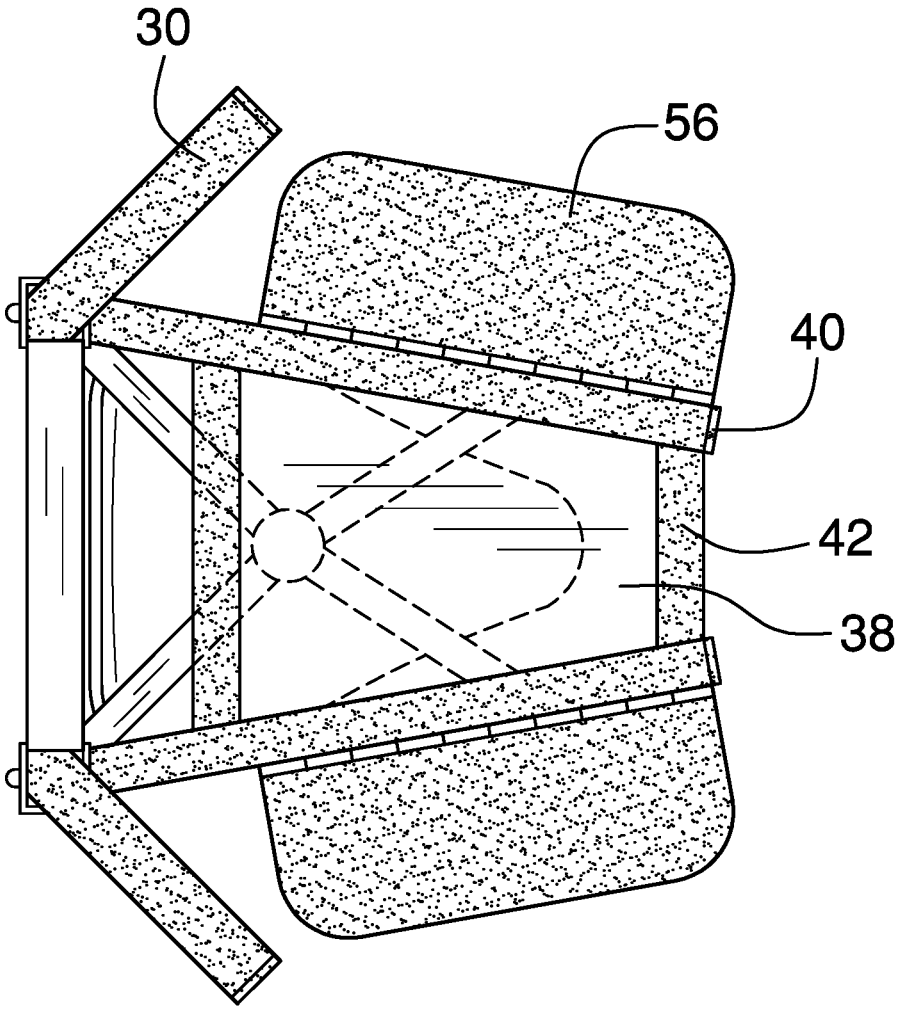
FIG. 4 is a bottom view of an embodiment of the disclosure.
Figure 5:
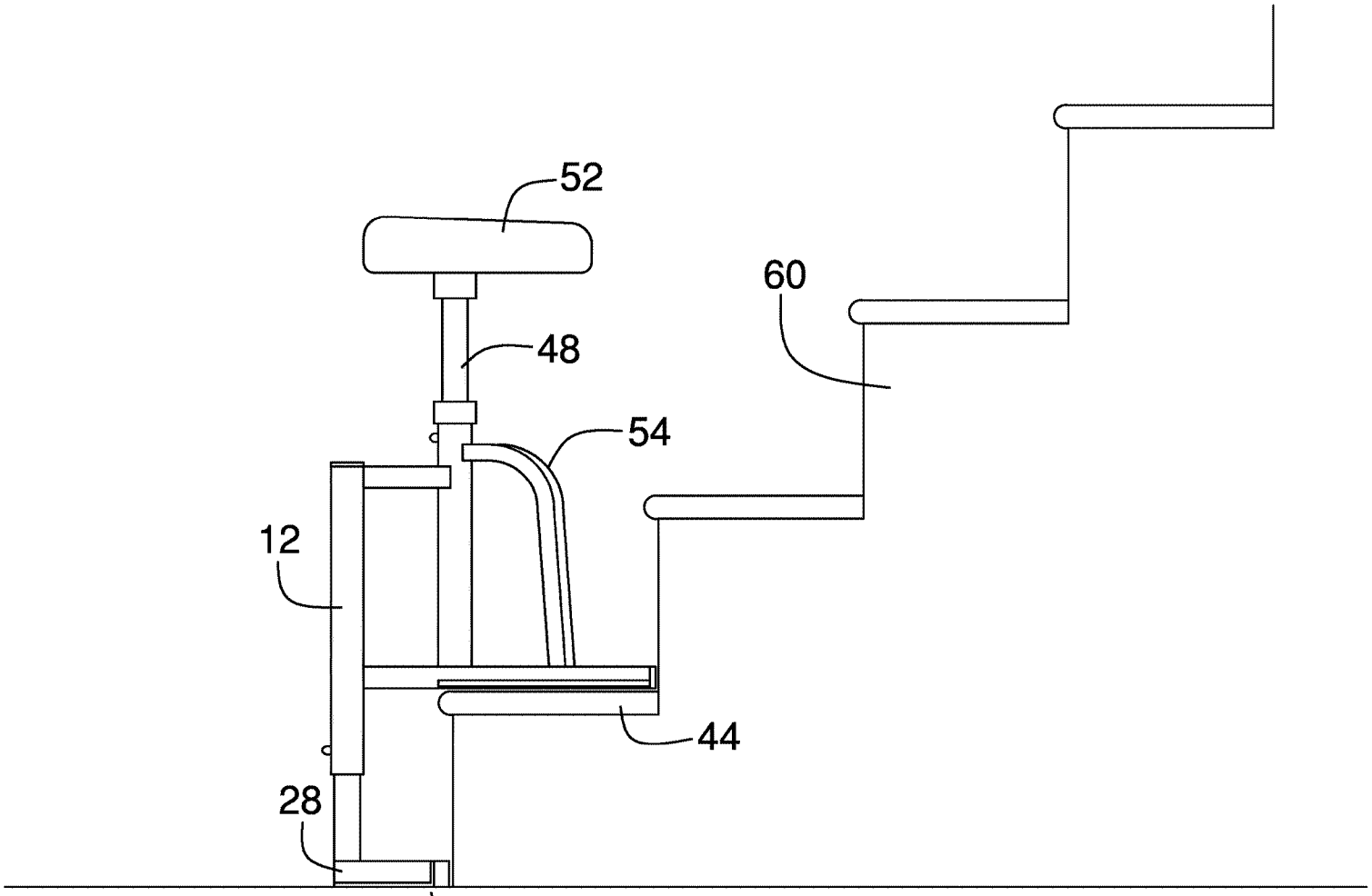
FIG. 5 is a side view of an embodiment of the disclosure.

With reference now to the drawings, and in particular to FIGS. 1 through 5 thereof, a new chair assembly embodying the principles and concepts of an embodiment of the disclosure and generally designated by the reference numeral 10 will be described.

As best illustrated in FIGS. 1 through 5, the staircase mountable chair assembly 10 generally comprises a pair of supports 12. The supports 12 are attached together and are shaped to retain the supports 12 in an upright position. Each of the supports 12 has a leg portion 14, a top end 16 and a bottom end 18. The leg portion 14 is telescopic such that the leg portion 14 has an adjustable height. The leg portions 14 include a lower section 20 and an upper section 22 wherein the upper section 22 is vertically movable relative to the lower section 20. The supports 12 may be comprised of aluminum but may be any other load bearing material.

The height of the leg portion 14 may be adjustable by including a spring loaded pin 24 in the lower section. The spring loaded pin 24 may be positionable in an inward position or outward position. In the inward position the spring loaded pin is positioned within the lower section. In the outward position the spring loaded pin 24 extends outwardly from the lower section 20. The upper section 22 may have a plurality of apertures 26 positioned through the upper section 22 at different vertical heights. The spring loaded pin 24 is configured to fit through the apertures 26 of the upper section such that when the spring loaded pin 24 is in the outward position through any one of the apertures 26 in the upper section 22 cannot move vertically on the lower section. When the spring loaded pin 24 is in the pushed position the upper section 22 can be moved vertically. The height of the leg portion is adjusted 14 when changing the aperture 26 that the spring loaded pin 24 is positioned through.

Alternatively, the height may be adjusted by both the upper section 22 and lower section 20 having apertures 26. The apertures 26 are configured to be lined up. A pin is configured to be positioned through the lined up apertures 26 such that when the pin is lined up through the aperture 26 of the lower section 20 and the aperture 26 of the upper section 22 the leg portion 14 is locked at a height. The height may be adjusted by removing the pin and lining up another pair of apertures 26 on the upper sections 22 and lower sections 20 and positioning the pin through. However, other means of securely adjusting the height of the leg section 14 may be used.

The supports 12 each further include a foot portion 28 that is attached to and extends outwardly from leg portion 14. The foot portion 28 is positioned adjacent to the bottom end 18. The foot portion 28 of one of the supports 12 is angled away from the foot portion 28 of another one of the supports 12. An elastomeric coating 30 may be positioned on a bottom side 32 of the foot portions 28. The elastomeric coating 32 extends over a distal end 34 of the foot portion 32 relative to the leg portion 14. The elastomeric coating 30 may further form treads 36 to prevent the assembly 10 from sliding while in the upright position.

A base 38 is attached to and extends outwardly from the supports 12. The base 38 lies in a horizontal plane when the supports 12 are positioned in the upright position. The base 38 includes a pair of rods 40. Each of the rods 40 is attached to and extends away from one of the supports 12. A plate 42 is attached to and extends between the rods 40 and the base 38 is attached to the upper sections 22. The base 38 is positionable on an upper step 44 when the supports 12 are on a next adjacent lower step 46. A post 48 is attached to and extends upwardly from the base 38. The post 48 has an upper end 50 and a seat 52 is attached to the upper end 50. The seat 52 is rotatable with respect to the base 38. The post 48 is telescopic and has an adjustable height.

A plurality of braces 54 is attached to the supports 12 such that each of the supports 12 has one of the braces 54 attached thereto. Each of the rods 40 has one of the braces 54 attached thereto with each of the braces 54 being attached to the post 48. A pair of footplates 56 each attached to the base 38 and positioned on opposite and lateral sides of the base 38 such that the base 38 is positioned between the footplates 56. Each of the footplates 56 is hingedly coupled to the base 38 such that the footplates 56 are positionable in a stored position extending downwardly from the base 38 or in a deployed position that is co-planar with the base 38. Locking members, not shown, may be provided to retain the footplates in the deployed position.

A plurality of storage pockets 58 is attached to and extending between the supports 12. Each storage pockets 58 is less than 8.0 inches deep and is configured for containing a plurality of tools. The storage pockets 58 may each be comprised of canvas, elastic or other materials appropriate for containing tools.

In use, the assembly 10 is used as a sitting assembly for working on stairs 60. The pair of supports 12 works in conjunction with the base 38 to keep the assembly 10 in an upright position. The pair of supports 12 is positioned on a lower step 46 while the base 38 is positioned on the adjacent upper step 44. The leg portion 14 is adjustable as to adjust the height of the base 38 to lay on the adjacent upper step 44. The seat 52 height may be adjusted for the user's comfort. While in the upright position a user can sit in the seat 52 and work on a step of the staircase 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A chair assembly configured for usage while working on a staircase comprising:

a pair of supports, said supports being attached together and said supports having a shape to retain said supports in an upright position;

a base being attached to and extending outwardly from said supports, said base lying in a horizontal plane when said supports are positioned in said upright position, said base including a pair of rods, each of said rods being attached to and extending away from one of said supports, a plate being attached to and extending between said rods;

said base being configured to be positioned on an upper step when said supports are on a next adjacent lower step;

a post being attached to and extending upwardly from said base, said post having an upper end, a seat being attached to said upper end.

2. The chair assembly according to claim 1, wherein each of said supports has an adjustable height such that said base is vertically movable when said supports are vertically adjusted.

3. The chair assembly according to claim 1, further including a plurality of braces, each of said supports having one of said braces attached thereto, each of said rods having one of said braces attached thereto, each of said braces being attached to said post.

4. The chair assembly according to claim 1, further including a plurality of storage pockets being attached to and extending between said supports, said storage pockets being configured for containing a plurality of tools.

5. The assembly of claim 1, further comprising:

each of said supports having:

a leg portion having a top end and a bottom end, said leg portion being telescopic such that said leg portion has an adjustable height, said leg portion including a lower section and an upper section wherein said upper section is vertically movable relative to said lower section;

a foot portion being attached to and extending outwardly from said leg portion, said foot portion being positioned adjacent to said bottom end, said foot portion of one of said supports being angled away from said foot portion of another one of said supports;

an elastomeric coating being positioned on a bottom side of said foot portion, said elastomeric coating extending over a distal end of said foot portion relative to said leg portion;

said base being attached to said upper sections;

said seat being rotatable with respect to said base, said post being telescopic and having an adjustable height;

a plurality of braces, each of said supports having one of said braces attached thereto, each of said rods having one of said braces attached thereto, each of said braces being attached to said post;

a pair of footplates, each of said footplates being attached to said base and positioned on opposite and lateral sides of said base such that said base is positioned between said footplates, each of said footplates being hingedly coupled to said base such that said footplates are positionable in a stored position extending downwardly from said base or in a deployed position being co-planar with said base; and a plurality of storage pockets being attached to and extending between said supports, said storage pockets being less than 8.0 inches deep, said storage pockets being configured for containing a plurality of tools.

6. The chair assembly according to claim 1, wherein said post is telescopic and having an adjustable height.

7. The chair assembly according to claim 1, wherein said seat is rotatable relative to said base.

8. A chair assembly configured for usage while working on a staircase comprising:

a pair of supports, said supports being attached together and said supports having a shape to retain said supports in an upright position, each of said supports including a leg portion having a top end and a bottom end, said leg portion being telescopic such that said leg portion has an adjustable height, said leg portion including a lower section and an upper section wherein said upper section is vertically movable relative to said lower section, said base being attached to said upper section, and a foot portion being attached to and extending outwardly from said leg portion, said foot portion being positioned adjacent to said bottom end, said foot portion of one of said supports being angled away from said foot portion of another one of said supports;

a base being attached to and extending outwardly from said supports, said base lying in a horizontal plane when said supports are positioned in said upright position, said base being configured to be positioned on an upper step when said supports are on a next adjacent lower step; and a post being attached to and extending upwardly from said base, said post having an upper end, a seat being attached to said upper end.

9. The chair assembly according to claim 8, wherein each of said supports further includes an elastomeric coating being positioned on a bottom side of said foot portion, said elastomeric coating extending over a distal end of said foot portion relative to said leg portion.

10. A chair assembly configured for usage while working on a staircase comprising:

a pair of supports, said supports being attached together and said supports having a shape to retain said supports in an upright position;

a base being attached to and extending outwardly from said supports, said base lying in a horizontal plane when said supports are positioned in said upright position;

said base being configured to be positioned on an upper step when said supports are on a next adjacent lower step;

a post being attached to and extending upwardly from said base, said post having an upper end, a seat being attached to said upper end; and a pair of footplates, each of said footplates being attached to said base and positioned on opposite and lateral sides of said base such that said base is positioned between said footplates, each of said footplates being hingedly coupled to said base such that said footplates are positionable in a stored position extending downwardly from said base or in a deployed position being co-planar with said base.

* * * * *